United States Patent [19]

Mori

[11] Patent Number: 4,966,105

[45] Date of Patent: Oct. 30, 1990

[54] LUBRICATING OIL SUPPLY DEVICE FOR INTERNAL COMBUSTION ENGINE

[75] Inventor: Atsushi Mori, Iwata, Japan

[73] Assignee: Sanshin Kogyo Kabushiki Kaisha, Hamamatsu, Japan

[21] Appl. No.: 673,905

[22] Filed: Nov. 21, 1984

[30] Foreign Application Priority Data

Dec. 5, 1983 [JP] Japan ..... 58-228516
Dec. 5, 1983 [JP] Japan ..... 58-228517

[51] Int. Cl.[5] ..... F02M 39/00

[52] U.S. Cl. ..... 123/73 AD; 123/463; 123/196 R; 184/6.8

[58] Field of Search ..... 123/73 AD, 196 R, 198 DB, 123/198 D, 577, 463; 184/6.8

[56] References Cited

U.S. PATENT DOCUMENTS 2,935,057 5/1960 Perlewitz .
3,212,485 10/1965 Werner ..... 123/73 AD
3,653,784 4/1972 Leiterman ..... 123/73 AD
3,886,914 6/1975 Ahrns ..... 123/73 AD
3,913,551 10/1975 Shaver ..... 123/73 AD
4,057,041 11/1977 Sakai ..... 123/73 AD
4,381,741 5/1983 Walsworth .
4,473,340 9/1984 Walsworth .
4,551,076 11/1985 DuBois ..... 123/73 AD

FOREIGN PATENT DOCUMENTS 58-93908 6/1983 Japan .

*Primary Examiner*—Carl Stuart Miller
*Attorney, Agent, or Firm*—Ernest A. Beutler

[57] ABSTRACT

A fuel, lubricant supply system for a carburetor of a two-cycle internal combustion engine wherein both fuel and lubricant are delivered to the fuel bowl of the carburetor. The amount of lubricant delivered is proportioned in response to the air flow through the carburetor and the amount of fuel delivered is controlled in response to the output pressure if the lubricant pump for preventing the operation of the engine with insufficient lubricant. In one embodiment, the air flow is sensed by sensing static pressure at the throat of the venturi of the carburetor and in the other embodiment, the air flow is sensing dynamic air pressure at the inlet to the carburetor.

16 Claims, 2 Drawing Sheets

LUBRICATING OIL SUPPLY DEVICE FOR INTERNAL COMBUSTION ENGINE

BACKGROUND OF THE INVENTION

This invention relates to a lubricating oil supply device for internal combustion engines and more particularly to an improved lubricating system for engines of the two-cycle type.

In the simpliest form of lubricating two-cycle internal combustion engines, lubricant is mixed by the operator with the fuel in a predetermined ratio and the lubricant fuel mixture is supplied to the engine for lubrication and running. Although this type of arrangement offers extreme simplicity, the ratio of lubricant to fuel is not ideal for all running conditions, it provides some inconvenience for the operator and it runs the risk that the operator will forget to add lubricant to the fuel and may damage the engine. In order to obviate some of these problems, it has been proposed to provide a system wherein fuel and lubricant are each supplied to the engine from separate reservoirs and in ratios which offer the opportunity of control for specific running conditions. For example, in my copending application entitled "lubricating System For Two-Cycle Internal Combustion Engine", Ser. No. 660,748, filed Oct. 15, 1984, and assigned to the assignee of this application, there is disclosed a system of this general type. As disclosed therein, a flow sensor is incorporated for sensing the amount of fuel flowing to the engine and the lubricant is supplied to the fuel line in a proportion dependent upon the fuel flow. Although such devices have considerable advantage, they necessitate the use of fuel flow detectors, and other electronic components for measuring and supplying the appropriate amount of lubricant.

It is, therefore, a principal object of this invention to provide an improved and simplified for supplying lubricating oil for an internal combustion engine.

It is another object of this invention to provide a separate lubricating system for an internal combustion engine wherein the amount of lubricant added to the fuel is controlled in response to the fuel flow in a simplified and yet effective manner.

A disadvantage with the use of separate lubricating systems of the type described is that the quantity of lubricant in the lubricant supply tank may be depleted before the fuel in the fuel storage tank is depleted. If this happens and the engine is continued to be operated, there can be a danger of seizure or other damage. Devices have been proposed that will discontinue or reduce the amount of fuel flow when the lubricant becomes depleted, however, such devices have been very complicated and have, for the most part, relied upon electrical sensing and control devices.

It is, therefore, a further object of this invention to provide a lubricant supply system for an internal combustion engine wherein the fuel flow is also controlled in response to the lubricant control.

It is a yet further object of this invention to provide an improved and simplified arrangement for discontinuing or restricting the fuel flow in the event the lubricant becomes depleted.

SUMMARY OF THE INVENTION

This invention is adapted to be embodied in a fuel lubricant supply system for a two-cycle internal combustion engine having an induction system for supplying a: least an air charge to the engine, charge forming means for supplying a fuel charge to the engine, a source of lubricant, and lubricating means for delivering lubricant from the lubricant source to the engine. In accordance with this feature of the invention, means are provided for varying the amount of lubricant delivered by the lubricant means in response to the fLow through a portion of the induction passage.

Another feature of the invention is adapted to be embodied in a fuel, lubricant supply system for a two-cycle internal combustion engine having fuel supply means for delivering fuel under pressure to the engine, lubricant supply means for delivering lubricant under pressure to the engine and wherein the fuel supply means and the lubricant supply means include separate fuel and lubricant pumps. In accordance with this feature of the invention, the amount of fuel supplied to the engine is controlled by the pressure of the output of the lubricant pump so as to prevent the flow of fuel when the flow of lubricant is restricted.

DETAILED DESCRIPTION OF THE PREFERRED EMBODIMENTS

Figure 1:
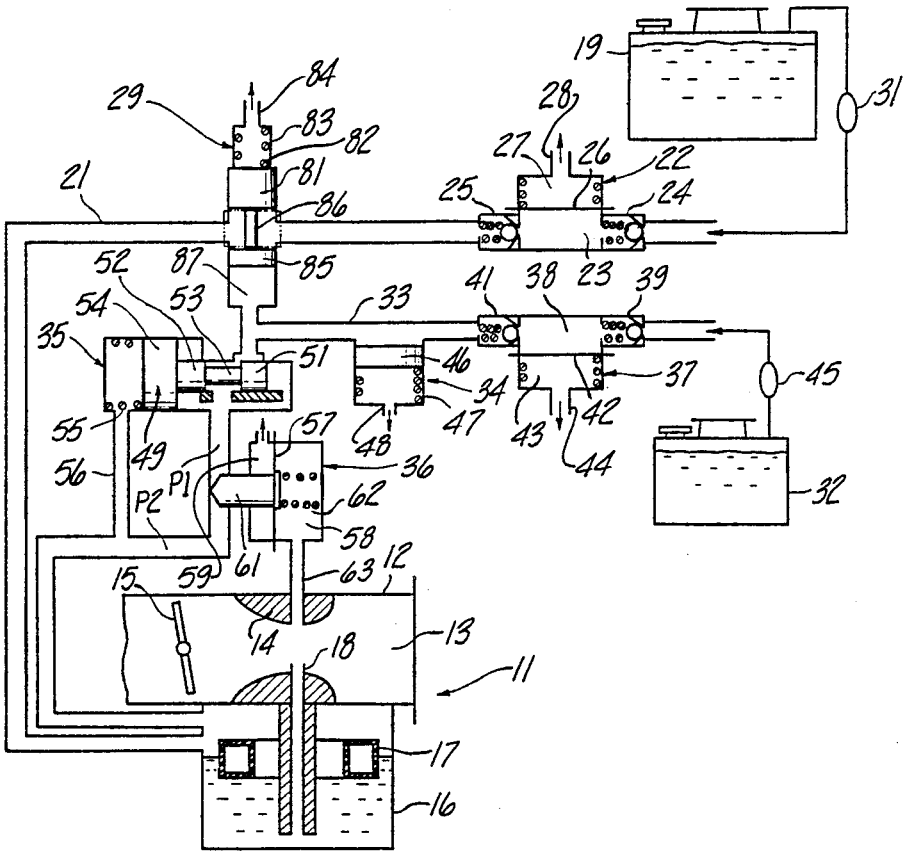
FIG. 1 is a partially schematic, partially cross-sectional view of a fuel and lubricant supply system for a two-cycle internal combustion engine constructed in accordance with an embodiment of the invention.
Figure 2:
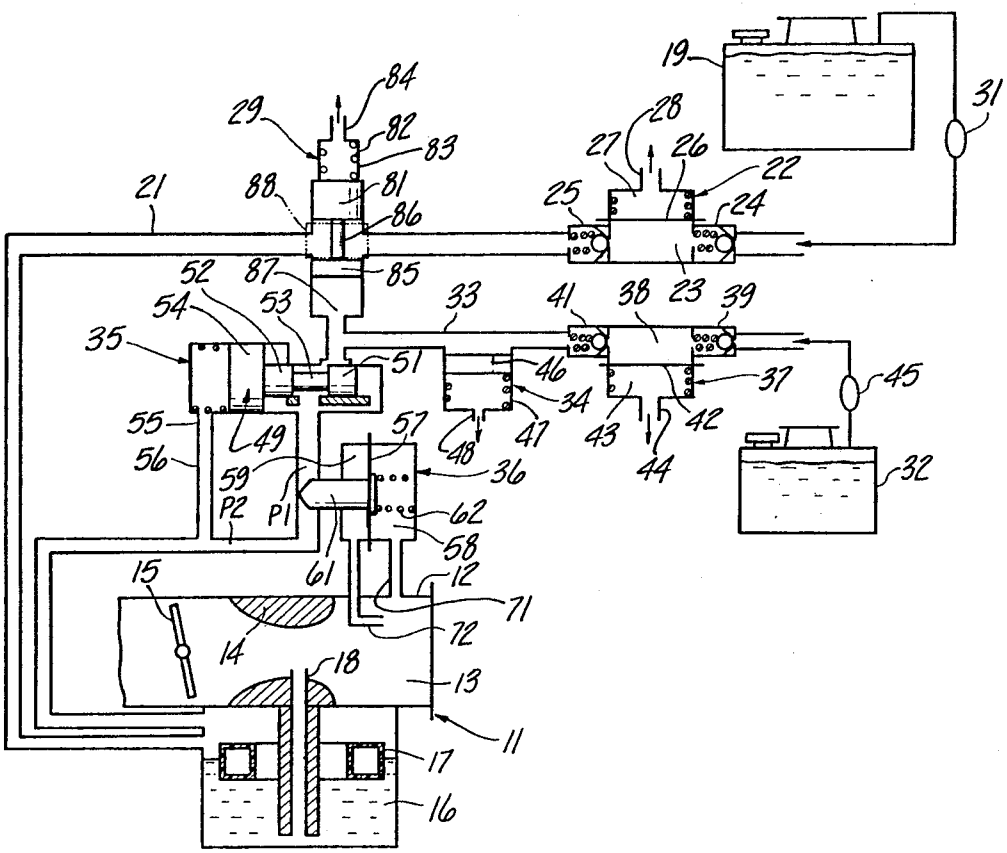
FIG. 2 is a view in part similar to FIG. 1 and shows another embodiment of the invention.

FIGS. 1 and 2 of the drawings illustrate, respectively, two embodiments of the invention. Many components of each of these embodiments are the same and, for that reason, both embodiments will be described simultaneously. The differences between the two embodiments will be described when the description of the differing components is reached.

Each embodiment is intended for use to supply a fuel lubricant mixture to the induction system of a two-cycle internal combustion engine for powering the engine as well as for lubricating it. The internal construction of the engine may be of any known type and, for that reason, the engine has not been illustrated in detail. Suffice it to say that the engine is supplied with a fuel-/air mixture from a charge forming device in the form of a carburetor indicated generally by the reference numeral 11 with lubricant being added to the fuel. The carburetor 11 of each embodiment is adapted to supply the fuel, lubricant air mixture to the engine through an appropriate introduction system. The carburetor 11 includes a main body portion 12 that defines an induction passage 13 in which a venturi section 14 and flow con&rolling throttle valve 15 are positioned. A fuel bowl 16 depends from the main body portion 12 and contains a float 17 for providing a uniform head of a fuel lubricant mixture which is supplied to the induction passage 13 in a suitable manner including a main discharge nozzle 18. The specific construction of the carburetor 11 is not material to the invention, except as heretofore described, and for that reason the details of the flow circuits are not illustrated nor will they be described.

Fuel is supplied to the carburetor fuel bowl 16 from a remotely positioned fuel storage tank 19 via a line 21. A fuel pump, indicated generally by the reference numeral 22, is positioned in the line 21 for pressurizing the fuel that is delivered to the fuel bowl 16. The fuel pump 22 is of the vacuum operated type and includes a pumping chamber 23 to which fuel is delivered via an inlet check valve 24 and from which it is discharged back to the conduit 21 via a discharge check valve 25. A diaphragm 26 is provided for varying the volume in the pumping chamber 23 and for pumping the fuel. The diaphragm 26 defines one side of the pumping chamber 23 and is exposed on another side to a vacuum chamber 27 that communicates with the crankcase of the associated engine via a conduit 28 so that the pressure fluctuations occurring in the crankcase of the associated engine will be transmitted to the chamber 27 for causing the diaphragm 26 to alternately expand and contract the volume of the pumping chamber 23 for pumping the fuel through the line 21.

A fuel control valve indicated generally by the reference numeral 29, is positioned in the conduit 21 downstream of the fuel pump 22 for a reason to be described. In addition, a manually operated priming pump 31 is positioned in the line 21 between the tank 19 and the engine operated fuel pump 22 for delivering a priming mixture of fuel to the engine upon manual operation of &he manual pump 31 in a known manner.

Lubricant is also supplied to the fuel bowl 16 for mixing with the fuel before delivery to the engine through the discharge circuits of the carburetor 11. The lubricant is supplied from a remotely positioned lubricant tank 32 and is delivered through a line 33 in which an accumulator 34, pressure regulating valve 35 and flow regulator 36 are incorporated. The lubricant from the tank 32 is pressurized in the line 33 by means of a lubricant pump 37 which has a construction generally of the same type as the fuel pump 22. The lubricant pump 37 includes a pumping chamber 38 to which lubricant is delivered through an inlet check valve 39 and from which it is delivered back to the line 33 through a discharge check valve 41. A diaphragm 42 defines one wall of the pumping chamber 38 and is exposed on its other side to a vacuum chamber 43. The vacuum chamber 43 is supplied with the pressure from the crankcase chamber through a conduit 44 so as to cause the diaphragm 41 to oscillate in position and alternatively expand and contract the pumping chamber 38 so as to pressurize the lubricant in the line 33.

A manually operated priming pump 45 is positioned in the line 33 between the lubricant pump 37 and the lubricant reservoir 32 for delivering priming lubricant to the caruburetor 16 and lubricant pump 37.

The accumulator 34 is positioned in the line 33 downstream of the lubricant pump 37 so as to dampen the pulsations of the pressure in the line 33. The accumulator 34 includes a piston 46 that is biased by means of a spring 47 so as to dampen fluctuating pressures in the line 33. The side of the piston 46 that is engaged by the spring 47 is exposed to atmospheric pressure through a vent line 48.

The pressure regulator valve 35 is designed so as to maintain a constant pressure drop across the flow regulating valve 36 so that the upstream pressure P1 is at a fixed pressure differential above the downstream pressure P2. For this purpose, the pressure regulator valve 35 includes a valve spool 49 that has a pair of lands 51 and 52 that are separated by a relief 53. The lands 51 and 52 are slidably supported within a bore and have equal diameters. The land 52 is, in turn, connected to a larger diameter land 54 which is slidably supported within a bore and which is engaged on one side by a spring 55 of the coil compression type. A conduit 56 exposes this chamber to the pressure P2 downstream of the flow control valve 36.

The regulator valve 35 operates, as aforedescribed, so as to provide a constant pressure drop across the flow regulator valve 36 which is equal to the force of the spring Kf divided by the area of the land 54 which is identified as F3. The land 51 cooperates with an inlet port so as to throttle this inlet port. The inlet pressure $P_1$ is applied against the head of the portion of the spool forming the land 51 over an area $F_1$ and over an area of the piston portion 54 between it and the land 52 which area is indicated by the character F2. On the other hand, the pressure P2 downstream of the flow controlling valve 39 is transmitted through the passage 56 back to this area on the opposite side of the piston 54. Hence, for a pressure balance condition, the following equation holds true:

$$Kf+F3\cdot P2=(F1+F2)P1$$

Thus, from solving this equation, it will be found that the pressure differential $P_1$ minus $P_2$=Kf divided by F3 and the aforedescribed condition is met.

The flow controlling valve 39 is operative to provide a flow of lubricant through the conduit 33 to the fuel bowl 16 that is related to the air flow through the induction passage 13. The structure of the flow controlling valve 39 is the same in the embodiment of FIGS. 1 and 2, however, the two embodiments sense the flow in a slightly different manner. Therefore, only the structure of the flow controlling valves 36 will be described first.

Each flow controlling valve comprises an outer housing that is divided by a diaphragm 57 into a first chamber 58 and a second chamber 59. A valve element 61 is affixed to the diaphragm 57 within the chamber 59 and extends into the portion of the line 33 downstream of the pressure regulating valve 35 and upstream of the sensing port 56 for controlling the effective area of this passage and, accordingly, the flow through it. In each embodiment, a coil compression spring 62 is received in the chamber 58 and urges the diaphragm 57 and valve element 61 toward a flow restricting position.

Referring now solely to the embodiment of FIG. 1, the flow controlling valve 36 of this embodiment operates to control the flow of lubricant through the line 33 in response to the air flow through the induction passage 13 s sensed by the vacuum or static pressure at the throat of the venturi section 14. For this purpose, a conduit 63 extends from the throat of the venturi section 14 to the chamber 58. The chamber 59, on the other hand, is vented to the atmosphere. Thus, as the air flow through the venturi section 14 increases, a greater vacuum will be established and the pressure differential between the chambers 58 and 59 will increase to have the diaphragm 57 deflect and compress the spring 62 so that the valve element 61 moves to a position wherein the flow through the line 33 is less restricted. Hence, a greater amount of lubricant will be delivered to the fuel bowl 16 in response to such higher flow conditions.

Referring now to the embodiment of FIG. 2, the chamber 58 is exposed to the static pressure in the induction passage 13 upstream of the venturi section 14 by means of a pressure sensing conduit 71. The chamber 59, on the other and, experiences dynamic pressure at this point by having a conduit 72 disposed so that its inlet end faces in the direction of air flow and thus receives ram air and senses the dynamic air pressure at this point. Hence, as a greater flow through the induction passage is experienced, the pressure in the conduit 72 and chamber 59 will be raised so as to urge the diaphragm 57 and flow controlling valve element 61 to a position wherein there is less restriction to flow through the line 33. Accordingly, the amount of lubricant delivered to the fuel bowl 16 will be increased and thus be in proportion to the amount of fuel being consumed.

Referring now again to the construction of both embodiments, the fuel controlling valve 29 is incorporated so as to control the amount of fuel flowing through the line 21 in response to the output pressure of the lubricant pump 37. This is done so as to insure the adequate mixture ratio and also to restrict or stop the flow of fuel in the event the lubricant supply becomes depleted or if the lubricant pump 37 fails to operate properly. The flow controlling valve 29 includes a first piston portion 81 that is slidable in a bore and which is urged in a downward direction by means of a coil compression spring 82 that is contained within an atmospheric pressure chamber 83. The chamber 83 is suitably provided with an atmospheric vent 84 so that the chamber 83 will be at atmospheric pressure. The piston 81 is connected to a second piston 85 by means of a reduced diameter section 86. The piston 85 is slidably supported within a chamber 87 that experiences pressure in the oil line 33 at a point between the accumulator 34 and the pressure regulating valve 35.

The flow control valve 29 operates in the following manner. As the pressure in the oil line 33 generated by the pump 37 increases, the piston 84 will be urged upwardly against the action of the spring 82 and the piston 81 will be moved to a less restricting position in the line 21. Hence, a full amount of fuel will be delivered to the fuel bowl 16. However, if the pressure of the discharge of the oil pump 37 decreases either due to a low level of oil in the reservoir 32 or due to some malfunction in the pump 37, the spring 82 will urge the piston 81 downwardly so as to restrict&. the flow through the line 21 and protect the engine from damage due to the large of lubricant.

If desired, the body of the valve assembly 29 may be provided with a transparent section 88 in the area where the piston 81 restricts the line 21 and the piston 81 may be colored, for example, red, so as to provide the operator with a visual warning of such a condition. That is, the operator will see the piston 81 through the transparent area 88 and will realize that the flow of lubricant to the fuel bowl 16 has diminished for some reason. He can then remedy the situation and damage to the associated engine will be avoided.

It should be readily apparent from the foregoing description that two highly effective and yet relatively simple mechanical embodiments have been illustrated and described that are effective to insure adequate mixture of lubricant and fuel delivered to a two-cycle internal combustion engine so as to maintain good lubricating qualities under all running conditions. In addition, each embodiment incorporates an arrangement wherein the likelihood of damage to the engine due to some malfunctioning of the lubricating system is avoided. Although two embodiments of the invention have been illustrated and described, various changes and modifications may be made without departing from the spirit and scope of the invention, as defined by the appended claims.

I claim:

1. In a fuel delivery system for a two-cycle internal combustion engine having an induction system for supplying at least an air charge to said engine, charge forming means for supplying a fuel charge to said engine, a source of lubricant, and lubricating means for delivering lubricant from said lubricant source to said engine, the improvement comprising means for varying the amount of lubricant delivered by said lubricating means in response to air flow through a portion of said induction system, said air flow though the portion of the induction system being sensed by a venturi section and a static pressure sensing device at the throat of the venturi section.

2. In a fuel delivery system for a two-cycle internal combustion engine having an induction system for supplying at least an air charge to said engine, charge forming means for supplying a fuel charge to said engine, a source of lubricant, and lubricating means for delivering lubricant from said lubricant source to said engine, the improvement comprising means for varying the amount of lubricant delivered by said lubricating means in response to air flow through a portion of said induction system, said air flow through the portion of the induction system being sensed by a dynamic pressure sensing device.

3. In a fuel delivery system for a two-cycle internal combustion engine having an induction system for supplying at least an air charge to said engine, charge forming means for supplying a fuel charge to said engine, a source of lubricant, and lubricating means for delivering lubricant from said lubricant source to said engine, the improvement comprising means for varying the amount of lubricant delivered by said lubricating means in response to air flow through a portion of said induction system, said charge forming means comprising a carburetor and the induction system portion comprises an induction passage of the carburetor, said carburetor having a fuel bowl to which fuel is delivered and to which lubricant is delivered from the lubricant source, and carburetor having a venturi section and the flow is sensed at the throat of the venturi section.

4. In a fuel delivery system for a two-cycle internal combustion engine having an induction system for supplying at least an air charge to said engine, a carburetor for supplying a fuel charge to said engine, a source of lubricant, said lubricating means for delivering lubricant from said lubricant source to said engine, the improvement comprising means for varying the amount of lubricant delivered by said lubricating means in response to air flow through said carburetor, said induction system, carburetor having a fuel bowl to which fuel is delivered and to which lubricant is delivered from the lubricant source, the flow through the carburetor being sensed by a dynamic pressure sensing device.

5. In a fuel delivery system for a two-cycle internal combustion engine having an induction system for supplying at least an air charge to said engine, charge forming means for supplying a fuel charge to said engine, a source of lubricant, and lubricating means for delivering lubricant from said lubricant source to said engine, the improvement comprising means for varying the amount of lubricant delivered by said lubricating means in response to the flow through a portion of said induction system, flow through the portion of the induction system being sensed by a venturi section and a static pressure sensing device at the throat of the venturi section, the amount of lubricant being controlled by delivering the lubricant at a constant pressure differential and controlling the amount of lubricant flowing.

6. In a fuel delivery system for a two-cycle internal combustion engine having an induction system for supplying at least an air charge to said engine, charge forming means for supplying a fuel charge to said engine, a source of lubricant, and lubricating means for delivering lubricant from said lubricant source to said engine, the improvement comprising means for varying the amount of lubricant delivered by said lubricating means in response to the flow through a portion of said induction system, said flow being sensed by a dynamic pressure sensing device, the amount of lubricant being controlled by delivering the lubricant at a constant pressure differential and controlling the amount of lubricant flowing.

7. In a fuel delivery system as set forth in claim 1 further including means for controlling the amount of fuel delivered to the engine in response to the pressure of the lubricant.

8. In a fuel delivery system as set forth in claim 7 wherein the fuel flow is substantially restricted if the lubricant pressure falls below a predetermined pressure.

9. In a fuel delivery system for a two-cycle internal combustion engine having an induction system for supplying at least an air charge to said engine, charge forming means for supplying a fuel charge to said engine, a source of lubricant, and lubricating means for delivering lubricant from said lubricant source to said engine, the improvement comprising means for varying the amount of lubricant delivered by said lubricating means in response to the flow through a portion of said induction system, said charge forming means comprising a carburetor and said induction system portion comprising an induction passage of the carburetor, said carburetor having a fuel bowl to which fuel is delivered and to which lubricant is delivered from the lubricant source, said carburetor having a venturi section, the flow being sensed at the throat of said venturi section, the amount of lubricant being controlled by delivering the lubricant at a constant pressure differential and controlling the amount of lubricant flowing.

10. In a fuel delivery system as set forth in claim 9 further including means for controlling the amount of fuel delivered to the engine in response to the pressure of the lubricant.

11. In a fuel delivery system as set forth in claim 10 wherein the fuel flow is substantially restricted if the lubricant pressure falls below a predetermined pressure.

12. In a fuel delivery system as set forth in claim 9 further including means for restricting the fuel flow if the lubricant pressure falls below a predetermined pressure.

13. In a fuel delivery system as set forth in claim 4 wherein the amount of lubricant is controlled by delivering the lubricant at a constant pressure differential and controlling the amount of lubricant flowing.

14. In a fuel delivery system as set forth in claim 13 further including means for controlling the amount of fuel delivered to the engine in response to the pressure of the lubricant.

15. In a fuel delivery system as set forth in claim 14 wherein the fuel flow is substantially restricted if the lubricant pressure falls below a predetermined pressure.

16. In a fuel delivery system as set forth in claim 13 further including means for restricting the fuel flow if the lubricant pressure falls below a predetermined pressure.

* * * * *